US007318689B2

(12) United States Patent
Kanflod et al.

(10) Patent No.: US 7,318,689 B2
(45) Date of Patent: Jan. 15, 2008

(54) METHOD AND DEVICE FOR ROCK BOLTING

(75) Inventors: Morgan Kanflod, Örebro (SE); Fredrik Öberg, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 135 days.

(21) Appl. No.: 10/554,615

(22) PCT Filed: May 12, 2004

(86) PCT No.: PCT/SE2004/000731

§ 371 (c)(1),
(2), (4) Date: Oct. 27, 2005

(87) PCT Pub. No.: WO2004/099569

PCT Pub. Date: Nov. 18, 2004

(65) Prior Publication Data

US 2006/0204341 A1 Sep. 14, 2006

(30) Foreign Application Priority Data

May 12, 2003 (SE) ..... 0301376

(51) Int. Cl.
*E21D 20/00* (2006.01)

(52) U.S. Cl. ..... 405/259.5; 405/259.3

(58) Field of Classification Search ..... 405/259.3, 405/259.5, 259.6, 259.1
See application file for complete search history.

(56) References Cited

U.S. PATENT DOCUMENTS

| | | | | |
|---|---|---|---|---|
| 3,311,012 | A * | 3/1967 | Williams | 405/259.5 |
| 3,326,004 | A | 6/1967 | Williams | |
| 3,379,019 | A * | 4/1968 | Williams | 405/259.3 |
| 3,693,359 | A * | 9/1972 | Karara | 405/259.3 |
| 3,695,045 | A | 10/1972 | Williams | |
| 4,459,067 | A | 7/1984 | Skogberg et al. | |
| 4,634,317 | A * | 1/1987 | Skogberg et al. | 405/259.3 |
| 4,664,561 | A * | 5/1987 | Frease | 405/259.6 |
| 5,997,219 | A * | 12/1999 | Krzysztalowicz et al. | 405/259.3 |

* cited by examiner

*Primary Examiner*—Frederick L. Lagman
(74) *Attorney, Agent, or Firm*—Mark P. Stone

(57) ABSTRACT

Method and device for rock bolting, wherein a tubular bolt (2) with closed cross-section is inserted and expanded for anchoring inside a bore hole (12), wherein the tubular bolt is expanded to contact in the inner portion of the bore hole, a tension element (3, 7, 8, 9) which is arranged in the outer portion of the bore hole with an inner part (7) attached to the tubular bolt (2) is pre-stressed and a settable medium is injected into the outer portion of the bore hole (14) between (27) the tension element and the wall of the bore hole and is allowed to set.

27 Claims, 2 Drawing Sheets

METHOD AND DEVICE FOR ROCK BOLTING

FIELD OF THE INVENTION

This invention concerns a method and a device for rock bolting according to the preambles of claims 1 and 11 respectively.

DESCRIPTION OF BACKGROUND ART

Pre-stressed wire bolts for rock enforcement are installed by grouting the wire bolt in a bore hole in the rock to be reinforced. Hereby cement concrete or any other binding agent is used as cement.

After injection of the binding agent this must be allowed to set, whereby the bolt has to be left unloaded during the setting period. After setting, a surface plate is mounted against the rock face, whereupon the bolt is pre-stressed through screw means or the like.

Because of the nature of the installation, the pre-tension will occur only along the part of the wire which is pulled free from the set binding agent. The length of the part being pulled free from binding agent is undefined which is a problem regarding the security of the fastener.

Altogether, the known method of installation of cable bolts is a lengthy and not an entirely impeachable procedure since the installation must be made in plural steps with intermediate waiting period.

Also the fact that the bolt can not be used prior to the setting of the binding agent is a considerable drawback in many cases. According to the above the strength of the completed installed bolt can also be questioned.

AIM AND MOST IMPORTANT FEATURES OF THE INVENTION

It is an aim of this invention to provide a method and a device wherein the problems of the background art are avoided. In particular it is provided a method and a device which leads to fast, rational, economic and safe installation.

Hereby it is achieved that pre-tension can be applied to the bolt before grouting thereof with a settable agent, which result in that the pre-tension will be well defined along a complete length of an element of the bolt and that the security of the installation is increased.

Further it is allowed that a rock bolt installed through a method according to the invention can be loaded immediately already after the tubular bolt has been expanded so as to be anchored in the bore hole. Hereby the unwanted waiting periods that are necessary in the method according to the background art are avoided and altogether is achieved a less lengthy and more economic rock bolting method.

By the channel for transmitting the said settable agent provides means which open for communication with the outside of the tension element through pressurizing to a certain pressure level, the same channel may be used for transmitting expansion medium and settable medium. When the same channel is used for transmitting medium for expanding the tubular bolt as well as for the settable medium, the said pressure level is set such that the channel opens at a pressure increase with a certain Δ-pressure above the expansion pressure.

It is preferred that the tension element is used for transmission of medium for expanding the tubular bolt, wherefore the tension element comprises a through channel for transmission of pressure water or the like. Hereby also the settable medium is transmitted through a channel in the tension element, wherein in particular it is preferred that it is this channel which can be opened through pressurizing to a certain pressure level which exceeds a certain predetermined threshold value.

By providing the tension element with a bursting plate, which breaks at a predetermined pressure level, this function is achieved in a simple way.

In particular the bursting plate can be an integral part of the material in the tension element, for example a drilled-out or milled-out portion having a certain remaining material thickness, which allows shearing of the material when said pressure level is reached.

Further advantages are achieved with the features of the further independent claims and the corresponding advantages are achieved in an inventive device for rock bolting.

BRIEF DESCRIPTION OF DRAWINGS

The invention will now be described closer at the background of embodiments and with reference to the annexed drawings, wherein.

DESCRIPTION OF EMBODIMENTS

Figure 1:
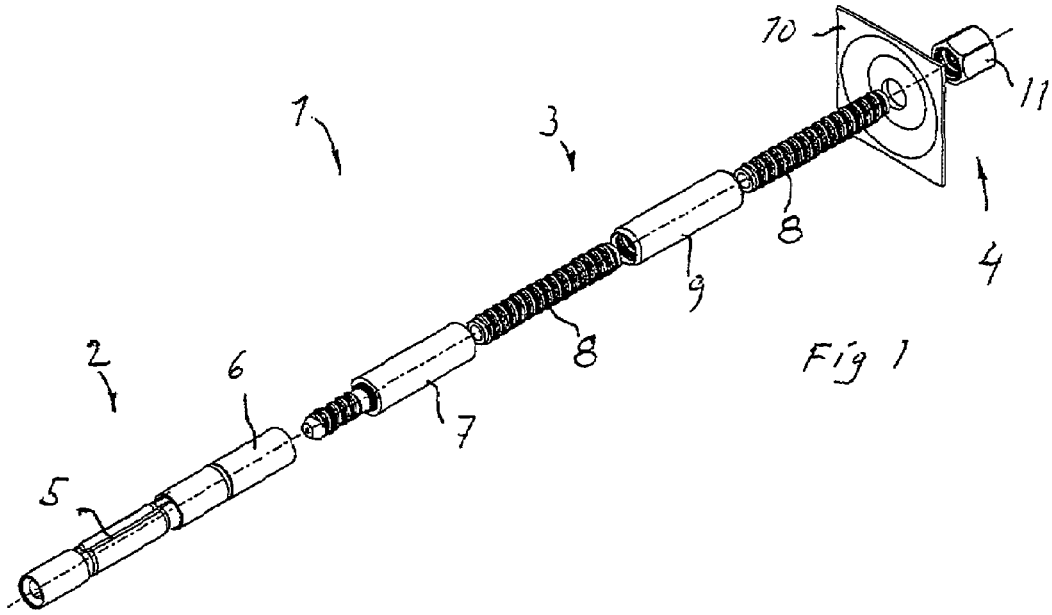
FIG. 1 shows a disassembled perspective view of a device for rock bolting according to the invention.

In FIG. 1 numeral 1 generally denotes a device for rock bolting including pre-stressing a rock bolt and with a tubular expandable rock bolt, essentially of the kind which is described in U.S. Pat. No. 4,459,067 (Atlas Copco AB).

The tubular bolt includes in general an expandable portion 5 and a fastening portion 6, into which is attachable a tubular tension element 3 including an inner portion 7 having a thread for cooperation with the fastening portion 6 and a female thread for cooperation with a tension section 8, which in turn over a joining element 9 is arranged to be threaded to one further tension section 8.

Preferably the parts included in the tension element 3 are standard components, which can be combined as desired, for example for adjustment to the depth of a bore hole wherein the device 1 is intended to be inserted.

An abutment element 4 includes an abutment plate 10 and a tension nut 11, which cooperates with an outside tension section 8, is arranged outside an insertion opening of said bore hole.

Figure 2:
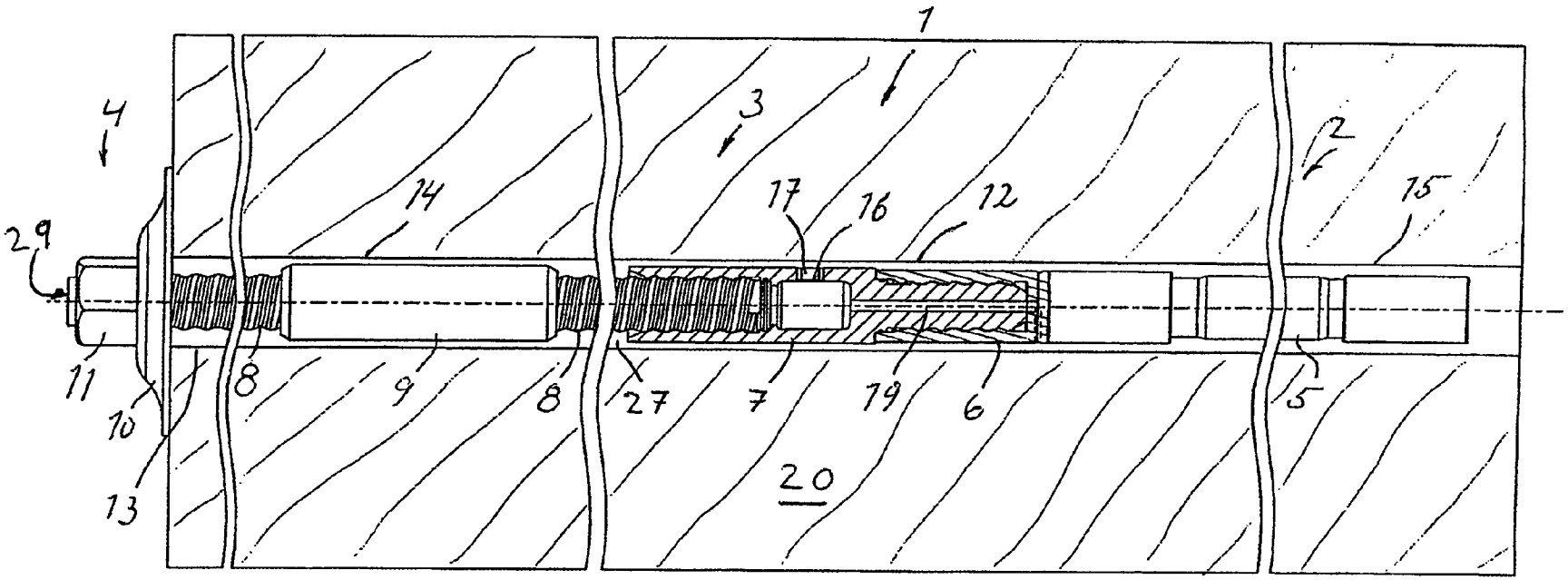
FIG. 2 shows, partly in section, the device in FIG. 1, assembled and inserted into a bore hole.

FIG. 2 shows the device in FIG. 1 in an assembled state and inserted into a bore hole 12, which is drilled in a rock structure 20. The bore hole 12 provides an insertion opening 13, an outer portion 14 and an inner portion 15.

The installation of a device for rock bolting is such that all the parts shown in FIG. 1 are tightly screwed together such that a sealed channel is established between the expandable portion 5 of the tubular bolt and the outside end 29 of the outermost tension section 8. Sealing may be achieved in a per se known manner through not further described sealing elements.

The outside end 29 of the outermost tension section 8 is after insertion of the device into the bore hole 12 connected to a pressure water source or the like for transmitting a pressure of as an example 300 bar to the expandable portion 5.

This expandable portion 5 will thereby be brought to firm anchoring against the inside of the inner portion 15 of the bore hole 12 so that already in this step a considerable anchoring of the complete rock bolt will occur.

After completed expansion, the tension element consisting of the parts 7, 8 and 9 may now be pre-stressed, which is made in such a way that the abutment plate 10 is pressed against the rock face 20 around the insertion opening 13 with the aid of the tension nut 11, which is tightened to a predetermined torque value.

After pre-stressing the device is now grouted-in in order to reinforce the anchoring as well as for assistance against corrosion, by injecting a settable medium into the space 27 between the tension element and the wall of the bore hole 12.

According to the preferred embodiment shown in FIG. 2, this is achieved in such a way that the channel inside the tension element is pressurized with a pressure which exceeds the pressure for expanding the expandable portion 5 and which is chosen to such a level that a bursting plate 6, which is positioned in the inner part 7 of the tension element, bursts so that an open channel is formed between this channel 19 and said space 27.

Thereupon the device is connected at its end portion 29 to a cement pump or any other source of a suitable settable medium.

Figure 3:
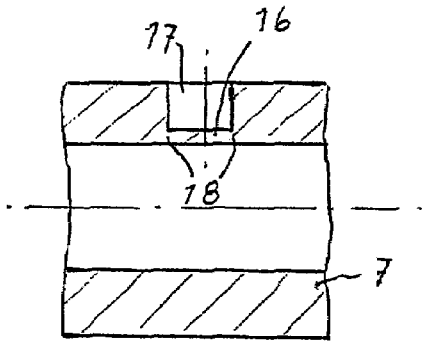
FIG. 3 shows a detail of the device in FIGS. 1 and 2 with a bursting plate.

FIG. 3 shows a detail of an inner portion 7 of a tension element with a bursting plate 16, which in this case is integrated in the material of the portion 7 in such a way that a milling operation 17 has been made so that the surrounding portion 18 of the bursting plate 6 provides a material thickness that can be sheared off at a certain pressurizing level.

Figure 4:
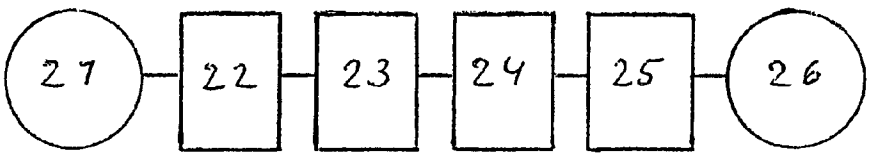
FIG. 4 shows diagrammatically a block diagram of steps included in a method according to the invention.

The method of rock bolting according to the invention can be summarized with reference to FIG. 4, wherein:

Position 21 denotes the start of the sequence,

Position 22 concerns assembling a device for rock bolting and inserting thereof into a bore hole, Position 23 concerns expansion of a tubular bolt, Position 24 concerns pre-stressing of a tension element, Position 25 grouting of settable material, and Position 26 end of the sequence.

Figure 5:
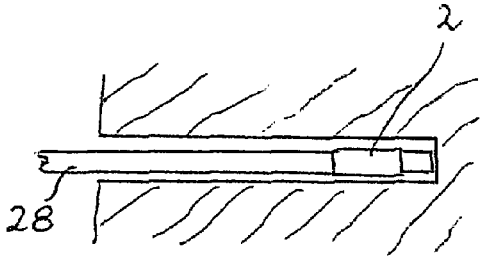
FIGS. 5 and 6 show diagrammatically alternative devices according to the invention.

The invention can be modified within the scope of the following claims, and as an example a device for rock bolting can be used, wherein medium for expanding the tubular bolt as well as settable medium is transmitted otherwise than through the tension element, for example through separate inserted and removable element (28 in FIG. 5), wherein in that case the tension element can be made homogenous.

The bursting plate can be a separate element inserted inside the tension element and also other means for establishing a channel for transmitting the settable medium can be used, for example an element having a valve function may be used. A further example is the use of a break-pin which is sheared off at a certain pressure and fixes a potentially movable valve element.

Figure 6:
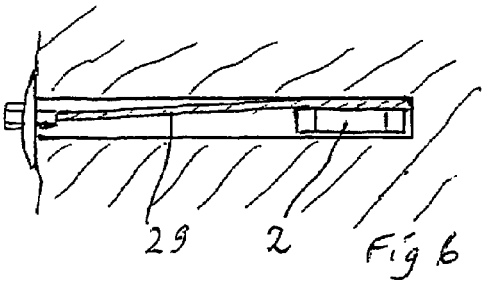

As a further alternative the tension element as an example can be anchored in a way that is shown in FIG. 6, through clamping of a tension element 29 between an expandable bolt 2 and the wall of the bore hole, wherein the tension element in that case can be formed of a wire, which then can be pre-tensioned and anchored and be secured against corrosion through injection of cement or any other binding agent according to the above.

The invention claimed is:

1. Method for rock bolting, wherein a tubular bolt (2) with closed cross-section is inserted and expanded for anchoring inside a bore hole (12), which has an inner (15) and an outer (14) portion as well as an inlet opening (13), and wherein the tubular bolt is expanded to contact in the inner portion of the bore hole, wherein:

a tension element (3, 7, 8, 9) which is arranged in the outer portion of the bore hole with an inner part (7) attached to the tubular bolt (2) is pre-stressed, a settable medium is injected into the outer portion of the bore hole (14) between (27) the tension element and the wall of the bore hole and is allowed to set, and a channel for transmitting said settable medium is opened for communication to the outside (27) of the tension element (3) through pressurizing to a certain pressure level.

2. Method according to claim 1, wherein:

medium for expanding the tubular bolt is transmitted through a channel (19) in the tension element (3).

3. Method according to claim 2, wherein:

said settable medium is transmitted through a channel inside the tension element (3).

4. Method according to claim 2, wherein:

said settable medium is transmitted (30) outside of the tension element (3).

5. Method according to claim 2, wherein:

the tension element (29) is attached through clamping between the tubular bolt (2) and the wall of the bore hole at the expansion of the former.

6. Method according to claim 1, wherein:

said settable medium is transmitted through a channel inside the tension element (3).

7. Method according to claim 1, wherein:

the channel is opened when a bursting plate (16) is made to break at said pressure level.

8. Method according to claim 1, wherein:

said settable medium is transmitted (30) outside of the tension element (3).

9. Method according to claim 8, wherein:

air being present inside the bore hole is evacuated (31) through a channel in the tension element (3) when injecting said settable medium.

10. Method according to claim 1, wherein:

medium for expanding the tubular bolt is transmitted through a separate bolt installation element (28) which is attached to a connection portion of the tubular bolt (2).

11. Method according to claim 10, wherein:

the tension element (3) is attached to said connection portion after expansion of the tubular bolt (2).

12. Method according to claim 1, wherein:

the tension element (29) is attached through clamping between the tubular bolt (2) and the wall of the bore hole at the expansion of the former.

13. Method according to claim 1, wherein:

the tension element (3) is pre-stressed between the tubular bolt (2) and an abutment element (4) arranged at the inlet opening of the bore hole.

14. Device (1) for rock bolting, including a tubular bolt (2) having a closed crosssection for insertion into and expansion for anchoring inside a bore hole (12) which has an inner and an outer portion and an insertion opening, said device comprising:

a tension element (3) to be arranged at the outer portion of the bore hole having an inner part (7) for attachment to the tubular bolt, means (10, 11) to pre-stress the tension element (3) in a length direction between the tubular bolt and the insertion opening, means for transmitting a settable medium to the outer portion of the bore hole between (27) the tension element and the wall of the bore hole, and a channel for transmitting said settable medium provides providing means (16) which are opened for communication to the outside of the tension element through pressurizing to a certain pressure level.

15. Device according to claim 14, said device comprising:

means for transmitting medium for expanding the tubular bolt (2).

16. Device according to claim 15, wherein:

said means for transmitting said settable medium includes a channel in the tension element (3).

17. Device according to claim 15, said device comprising:

a separate bolt installation element (28) which is fastenable to a connection portion on the tubular bolt (2) for transmitting medium for expanding the tubular bolt.

18. Device according to claim 15, wherein:

the tension element is provided with means for fastening to said connection portion after expansion of the tubular bolt.

19. Device according to claim 15, wherein:

the tension element (29) is formed so as to be anchored through clamping between the tubular bolt and the wall of the bore hole at the expansion of the former.

20. Device according to claim 14, wherein:

said means for transmitting said settable medium includes a channel in the tension element (3).

21. Device according to claim 14, wherein:

said means which is opening is a bursting plate (16), which is made to break at said pressure level.

22. Device according to claim 14, wherein:

said settable medium is arranged to be transmitted (30) outside of the tension element (3).

23. Device according to claim 22, said device comprising:

an evacuation channel (31) inside the tension element for evacuating air being present inside the bore hole when injecting said settable medium.

24. Device according to claim 23, wherein:

the tension element is provided with means for fastening to said connection portion after expansion of the tubular bolt.

25. Device according to claim 14, said device comprising:

a separate bolt installation element (28) which is fastenable to a connection portion on the tubular bolt (2) for transmitting medium for expanding the tubular bolt.

26. Device according to claim 14, wherein:

the tension element is provided with means for fastening to said connection portion after expansion of the tubular bolt.

27. Device according to claim 14, wherein:

the tension element (29) is formed so as to be anchored through clamping between the tubular bolt and the wall of the bore hole at the expansion of the former.

* * * * *

UNITED STATES PATENT AND TRADEMARK OFFICE

CERTIFICATE OF CORRECTION

PATENT NO. : 7,318,689 B2
APPLICATION NO. : 10/554615
DATED : January 15, 2008
INVENTOR(S) : Morgan Kanflod et al.

It is certified that error appears in the above-identified patent and that said Letters Patent is hereby corrected as shown below:

Column 4, Line 61 (Claim 14, Line 2):

Delete "crosssection" and substitute --cross-section--

Column 5, Line 7 (Claim 14, Line 15):

Delete "provides".

Signed and Sealed this

Sixth Day of May, 2008

JON W. DUDAS
*Director of the United States Patent and Trademark Office*